United States Patent [19]

Benedict et al.

[11] Patent Number: 4,723,665

[45] Date of Patent: Feb. 9, 1988

[54] TELESCOPING CLOSET GARMENT ORGANIZER

[75] Inventors: Charles E. Benedict; C. Joseph Goeke; William P. Thompson; Patricia C. Benedict, all of Tallahassee, Fla.

[73] Assignee: Benedict Engineering Company, Inc., Tallahassee, Fla.

[21] Appl. No.: 2,301

[22] Filed: Jan. 12, 1987

[51] Int. Cl.[4] ..... A47F 5/00

[52] U.S. Cl. ..... 211/168; 211/94; 211/96

[58] Field of Search ..... 211/94, 96, 116, 124, 211/168, 1.3

[56] References Cited

U.S. PATENT DOCUMENTS

| | | | |
|---|---|---|---|
| 1,081,848 | 12/1913 | MacDonald | 211/96 X |
| 2,987,193 | 6/1961 | Pajor | 211/96 X |
| 3,116,837 | 1/1964 | Kelly | 211/94 |
| 4,585,127 | 4/1986 | Benedict | 211/94 X |

FOREIGN PATENT DOCUMENTS

| | | | |
|---|---|---|---|
| 1333012 | 6/1963 | France | 211/96 |

*Primary Examiner*—Robert W. Gibson, Jr.
*Attorney, Agent, or Firm*—Dowell & Dowell

[57] ABSTRACT

A closet organizer for supporting a plurality of articles of clothing such as pants and skirts from a clothes rod in a closet wherein the organizer includes a housing which is selectively suspended from the clothes rod and is stabilized with respect thereto and from which a telescoping clothing rack assembly is slideably carried. The clothing rack assembly includes at least one telescoping slide member which is received within the housing and from which a plurality of vertically spaced pairs of horizontally swingable clothing support arms are suspended. The clothing support arms may be selectively moved forwardly of the clothes rod and thereafter adjustably pivoted outwardly relative to one another so as to facilitate placement and retrieval of articles of clothing with respect thereto.

28 Claims, 17 Drawing Figures

R
30
27
W
37
21
24
22
64
84
58
23
62
70
66
67
60
20
71
70
63
80
71

TELESCOPING CLOSET GARMENT ORGANIZER

BACKGROUND OF THE INVENTION

1. Field of the Invention

This invention is generally related to closet organizers and particularly to telescoping support racks which are utilized as closet organizers. Such organizers include telescoping article supports or rack assemblies which are carried by slide members movably disposed within a housing which mounts the article supports or rack assemblies relative to the clothes rod or other surface within a closet. The article support rack assembly includes a vertically extending post from which a plurality of pairs of vertically spaced article support arms are pivotally extended thereby enabling pairs of pants, skirts and other types of clothing to be suspended therefrom in an orderly fashion beneath the organizer housing. The housing of the closet organizers may include rearwardly telescoping bracket members for anchoring the organizers to the rear wall of a closet and also include integrally formed V-shaped slots in the upper surface thereof which provide a secure mounting surface for engaging the clothes rod in the closet.

2. History of the Art

There has been a growing emphasis to make more efficient use of closet storage space not only to permit a greater number of clothing articles to be stored in a given area but also to facilitate access to such articles. The need for organized storage units has increased due to the tendency in new building construction to reduce the amount of closet space within dwelling units.

In clothes closets, use has been made of various types of telescoping hangers or racks for supporting articles in movable relationship to the clothes rod. Such racks have often provided structure for supporting a plurality of articles in a space which has heretobefore been utilized to hang a single garment or item.

In U.S. Pat. Nos. Des. 227,436 and Des. 277,248 which are currently assigned to the assignee of the present invention, telescoping support racks are disclosed for supporting a plurality of belts, ties and other elongated items in a uniform and organized manner. Such racks are extendable outwardly from a normally stored position beneath housings which are mounted to the clothes rod to positions which are easily accessible thereby facilitating the placement and/or retrieval of articles with respect to the racks. Although such telescoping racks provide structure for organizing the hanging or storage of clothing accessories such as ties, belts, chains and the like, they are not designed to hang or store a plurality of larger and heavier clothing items such as pants or skirts. Other telescoping racks for such clothing accessories as belts, ties and the like are disclosed in U.S. Pat. No. Des. 273,645, U.S. Pat. Nos. 3,945,812 and 3,897,122 to McEvers; 3,389,807 to Manning et al.; 3,124,253 to Petrich; 3,335,872 to Dodich; 2,917,185 to Kovacs; 2,985,311 to Abil; 1,415,316 to Corbin and 2,569,761 to Hibbs. All of the foregoing racks have limited use for storing only selective smaller articles of clothing accessories and none of the references provide any structure for supporting a plurality of vertically arranged articles of clothing beneath a common support assembly.

In U.S. Pat. No. 4,585,127, also assigned to the assignee of the present invention, a telescoping closet or garment organizer is disclosed which includes garment and/or shoe bags having a plurality of individual article storage pockets provided thereon. The garment bags are suspended from a telescoping member which is carried by a housing mounted to the clothes rod in a closet. The telescoping member is mounted in suspended relationship beneath the clothes rod and is extendable perpendicularly with respect thereto so as to selectively orient the garment and/or shoe bags outwardly into the passageway of the closet for easy access thereto. Such a garment organizer provides suitable storage space for articles which may be concealed in pockets, however, it does not provide any structure for arranging articles which must be freely suspended in order to avoid wrinkling of the clothing such as when hanging or supporting pants, skirts and other similar articles of clothing.

Another type of garment organizer especially designed for clothing accessories including both narrow and wide accessories such as chains and scarves and the like is disclosed in pending U.S. patent application Ser. No. 890,306, filed July 29, 1986 and which is also assigned to the assignee of the present invention. The telescoping organizer disclosed in the copending application provides a rack for supporting relatively wide articles of clothing accessories including scarves and ties and the like in a two-tiered arrangement so as to facilitate an orderly arrangement of a plurality of such articles in a single vertical space. Integrally formed hooks are also provided for hanging chains and belts and the like. As with the prior design applications discussed above, there was no consideration of providing for an orderly arrangement for suspending or supporting larger articles of clothing which must be freely suspended in storage nor was there any consideration of providing multiple tiers of movable supports in a spaced vertical arrangement beneath the clothes rod in a closet.

In addition to the foregoing, in order to stabilize the garment organizers of many prior art structures with respect to the closet clothes rods, it was necessary to provide separate wall mounting brackets which were engagable with channels formed in the organizer housings. Such arrangements require a plurality of separate parts to be packaged and thereafter assembled by the consumer and therefore presented mounting and/or assembly problems especially for individuals who have limited mechanical ability.

Some other examples of prior art closet or garment organizers are disclosed in U.S. Pat. No. Des. 135,656 to Williams; U.S. Pat. Nos. 862,841 to Newport; 2,355,835 to Whalen; 3,754,664 to Kotkins and 3,550,784 to Batts.

SUMMARY OF THE INVENTION

This invention is directed to a telescoping closet organizer for supporting a plurality of clothing articles including pants, trousers, skirts and the like in vertically spaced relationship with respect to one another and which are supported on a clothing support rack which is slidingly suspended from a housing which is mounted to the clothes rod in a closet. The housing carries at least one forwardly extendable slider member having a vertically oriented support post mounted thereto so as to be movable therewith. A plurality of pairs of opposing clothing support arms are pivotably mounted to the vertical post so as to be swingable away from one another in a substantially horizontal plane about their inner ends. The clothing support arms are generally equally vertically spaced with respect to one another along the length of the vertical support post. The clothing support arms may include one or more clips or clamps for selectively engaging articles of clothing to be supported or suspended therefrom. In a preferred embodiment of the invention, the housing also includes a rearwardly slideable stabilizer bracket which includes a pair of spaced generally parallel arms which have one end slideably received within the housing and which are connected at their outer ends by an intermediate flange which is selectively fastened to a wall in the closet. The stabilizer bracket is designed to be extended rearwardly of the housing so that the flange engages or abuts the wall of the closet adjacent the clothes rod after the housing has been mounted to the closet support rod.

It is one of the primary objects of the present invention to provide a closet organizer which includes a plurality of opposing pairs of arcuately swingable clothing support arms which are arranged in vertically spaced orientation with respect to one another and which are normally retained in generally parallel and proximate relationship so as to be arranged in a compact configuration underlying a housing from which the arms are slideably extendable. In this manner, pants, skirts or other articles of clothing may be suspended from each of the support arms and be oriented for storage beneath the housing of the organizer so as to be spaced from articles being supported or suspended adjacent thereto but which are easily accessible by urging the support arms outwardly from beneath the housing and thereafter pivoting the support arms outwardly relative to one another to provide for additional space between the support arms to facilitate the placement or retrieval of articles with respect thereto.

It is another primary object of the present invention to provide a closet organizer which is designed to be supported by the clothes rod in a closet having at least one forwardly extendable telescoping section or slide member from which an article support rack is suspended so as to permit articles carried thereby to be extended outwardly from a first storage position to a second accessible position and which also includes a rearwardly extending generally U-shaped bracket which is selectively secured to a wall at a point spaced from the clothes rod so that the two parallel leg portions thereof stabilize the organizer and prevent any rotational movement thereof with respect to the clothes rod.

It is another object of the present invention to provide a housing for a telescoping article support rack wherein the housing has an integrally molded V-shaped mounting slot formed in the upper generally central portion thereof with the slot having downwardly and inwardly tapering side walls which cooperatively and securely engage the closet clothes rod therebetween. A pair of openings are provided adjacent the tapered side walls of the slots and a flexible mounting strap extends therethrough and over the clothes rod so that the strap may be selectively tightened to draw the side walls of the slot into intimate engagement with the clothes rod. As the V-shaped slot extends across the entire width of the housing, the contact area with the clothes rod resists shifting of the housing relative to the clothes rod.

It is yet another object of the present invention to provide a telescoping closet organizer for supporting a plurality of items such as pants or skirts wherein a clothing rack may be pulled outwardly with respect to the clothes rod from which it is suspended and wherein the rack includes a plurality of swing-out arms which are movable to permit easy access to articles of clothing being suspended therefrom or clamped thereto.

It is also an object of the present invention to provide a closet organizer wherein a plurality of articles of clothing such as pants and skirts and the like may be suspended in vertical relationship with respect to one another so that more clothing may be suspended within a given area while also increasing the ease of access to such articles.

A further object of the present invention is to provide a telescoping support rack for clothing wherein the clothing may be supported on a plurality of vertically arranged pairs of support arms which may have pairs of clips associated therewith for selectively securing clothing thereto and which are also designed to simultaneously permit clothing to be draped over each of the arms thereby doubling the capacity of each of the support arms.

A further object of the invention is to provide a closet organizer having a plurality of pairs of vertically spaced swingable clothing support arms suspended from a telescoping carrier which is movable outwardly with respect to a housing which supports the organizer within the closet and wherein a vertical post which supports the support arms is reinforced by a gusset or flange which extends from the vertical post outwardly and upwardly to an engagement with a telescoping carrier whereby the weight of articles suspended therefrom is uniformly distributed along the carrier thereby facilitating the manipulation or movement of the carrier with respect to the housing.

Another object of the present invention is to provide a telescoping article support rack having a plurality of clothing support arms which are swingable with respect to a support housing and wherein the arms are designed to be movable between a position generally parallel with and underlying the housing and yet be movable outwardly in an arc of approximately 45° so as to permit easy access for placing or retrieving articles of clothing therefrom.

Another object of the present invention is to provide a telescoping closet organizer which can be mounted to the support or clothes rod of a closet without having to utilize separate mounting components and without having to align such components to insure proper horizontal placement of the unit with respect to the closet rod. In the present invention, the housing includes an integrally mounted V-shaped mounting section which is initially engaged and drawn into proximate relationship with the clothes rod and thereafter, the unit may be moved into a general horizontal relationship and secured using a rearward mounting bracket which extends outwardly into abutting engagement with the rear wall of the closet and which is selectively secured thereto. In this manner, the closet organizer is mounted in stabilized relationship beneath the clothes rod of the closet.

DESCRIPTION OF THE PREFERRED EMBODIMENT

Figure 1:
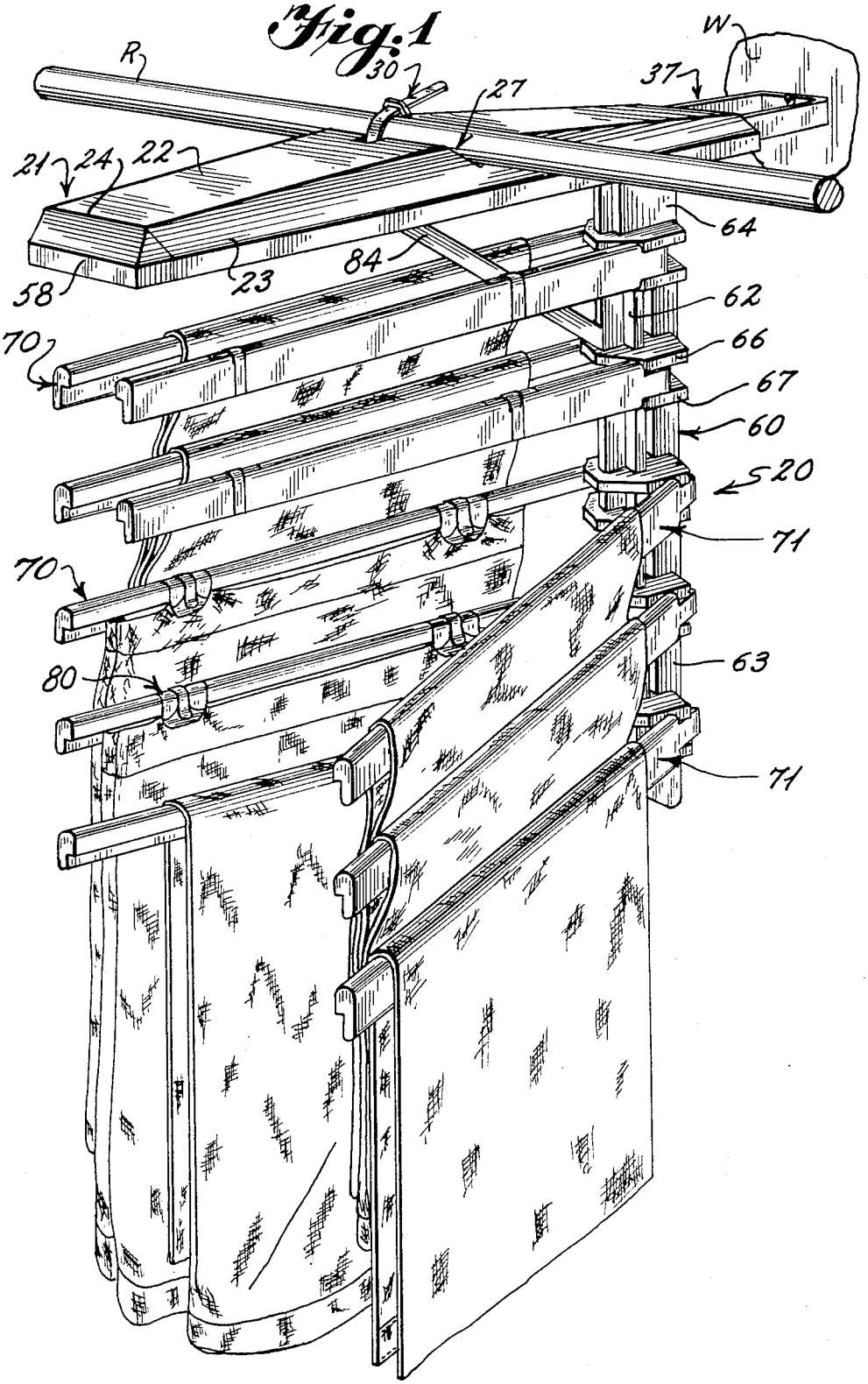
FIG. 1 is an illustrational view of the closet organizer of the present invention as shown being used to hang a plurality of pants and/or skirts with some of the clothing being draped over the hanger arms and other clothing being clasped to the hanger arms.

With continued reference to the drawings, the telescoping closet organizer 20 of the present invention is shown in FIG. 1 as being mounted to a closet clothes rod R so as to extend generally perpendicularly with respect thereto and outwardly from the rear wall W of the closet. The closet organizer includes an outer housing 21 having an upper wall 22 and depending side walls 23 which walls are oriented so as to create a generally U-shaped cross section. The forward end 24 of the housing is generally open whereas the rear end portion is closed by wall 25.

In order to mount the housing 21 to the support rod R in a closet, a V-shaped slot 27 is molded between the side walls and generally perpendicularly with respect to the longitudinal axis of the housing. The V-shaped slot is defined by inwardly tapering side walls 28. An opening 29 is provided in the base portion of the V-shaped slot for purposes of receiving a fastening strap 30 as will be discussed in greater detail hereinafter.

The central portion of the housing is shown as being somewhat greater in depth from the upper wall to the lower portion of the side walls of the housing than are the end portions thereof. As shown, the upper wall 22 of the housing extends upwardly from the forward end 24 thereof toward the V-shaped slot 27. In a like manner, the upper wall extends upwardly from the rear wall 25 to the V-shaped slot 27. Therefore, a substantial area of contact is created between the walls of the V-shaped slot and the clothes rod to increase the stability of the organizer when mounted to the clothes rod.

As previously mentioned, one of the unique features of the present invention is that the entire closet organizer may be mounted to the clothes rod of a closet and thereafter horizontally aligned and stabilized to the rear wall of the closet by utilizing but a single screw or other suitable device. Therefore, a screwdriver is the only tool necessary to accomplish a secure and level mounting of the organizer in a closet. The main housing 21 is initially attached to the closet clothes rod after the housing is positioned with the side walls of the V-shaped slot engaging opposite walls or opposite sides of the rod. A pair of spaced openings 32 are provided through the upper wall and are spaced just outwardly of the V-shaped slot. The openings 32 communicate with one another by way of the opening 29 in the bottom of the V-shaped slot. Each of the openings 32 is defined by arcuate depending guide walls 34 which serve to automatically guide the flexible mounting strap 30 from one opening toward the other when the strap is passed therethrough. Therefore, with the housing engaging the closet rod, the forward end 35 of the strap 30 is passed through one of the openings 32 and thereafter below opening 29 and upwardly through the opposite opening 32 and thereafter passed through the locking end 36 of the strap. By applying tension to the forward end of the mounting strap, the housing will be urged into tightly abutted engagement with the clothes rod.

After the housing has been secured to the clothes rod, a U-shaped bracket 37 is extended outwardly of the rear wall 25 of the housing until the end wall 38 of the bracket contacts the wall as shown in FIG. 1. The leveling of the housing 21 is accomplished by simply rotating the U-shaped bracket vertically until the end wall thereof is in parallel or flush abutting engagement with the rear wall of the closet. Thereafter, a screw or other fastener 39 is passed through an opening in the end wall of the U-shaped bracket in order to secure the same with respect to the wall.

Figure 4:
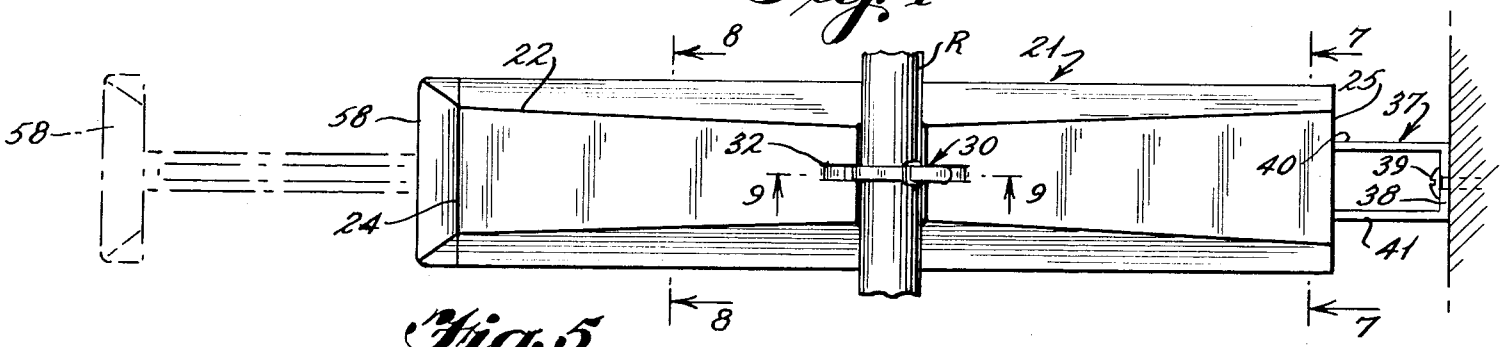
FIG. 4 is an enlarged top plan view of the closet organizer of FIG. 1 showing the telescoping support or slider member extended outwardly in dotted line.
Figure 5:
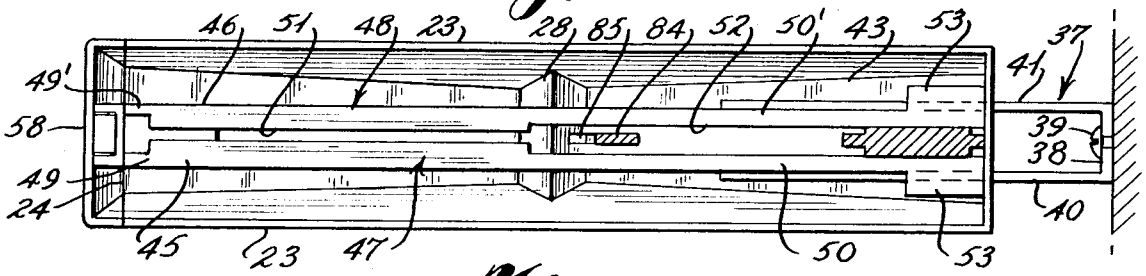
FIG. 5 is a bottom plan view of the housing and telescoping slider member and telescoping mounting bracket of the present invention taken along lines 5—5 of FIG. 3.
Figure 6:
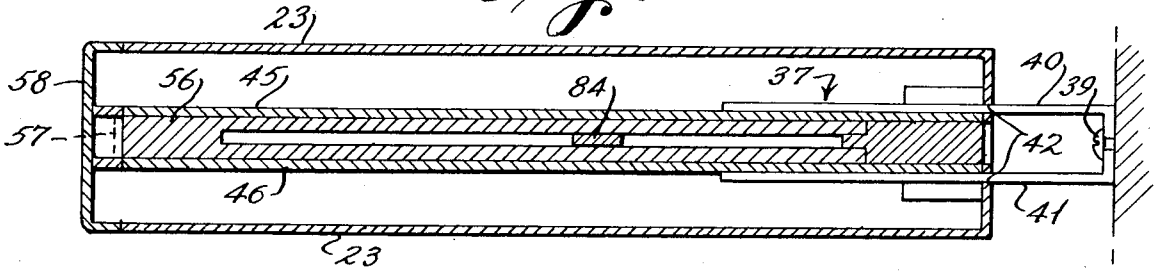
FIG. 6 is a cross sectional view along lines 6—6 of FIG. 3.
Figure 7:
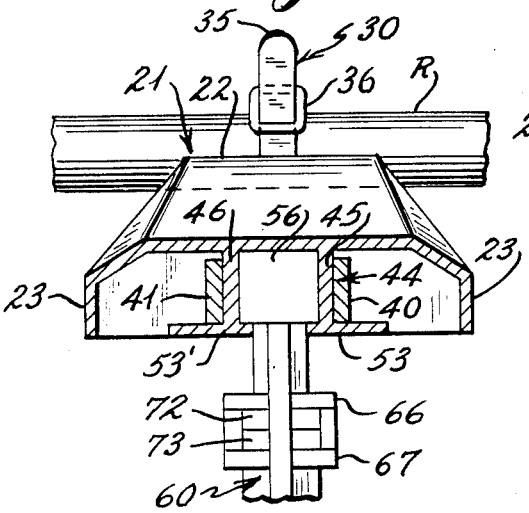
FIG. 7 is an enlarged cross sectional view taken along lines 7—7 of FIG. 4.

With particular reference to FIGS. 4–6, the housing 21 will be described in further detail. As previously mentioned, the U-shaped mounting bracket 37 extends telescopically from the rear end wall 25 of the housing so as to be selectively engagable with a wall which is spaced from the clothes rod. The U-shaped bracket includes generally parallel leg members 40 and 41 which are slideably supported within the housing 21 so that the end wall 38 of the U-shaped bracket may be adjustably oriented in horizontally spaced relationship with respect to the rear end wall of the housing. A pair of spaced generally rectangular openings 42 are provided through the rear end wall of the housing for purposes of permitting the leg members of the bracket to extend therethrough. The innermost ends of the leg members of the U-shaped bracket are supported within the housing between the inner surface of the upper wall shown at 43 and one end portion of an elongated guide channel assembly 44 which extends along the length of the housing.

The guide channel assembly 44 is defined by depending side walls 45 and 46 which extend along the entire length of the housing. A pair of elongated flange members 47 and 48 are integrally molded with the depending side walls of the guide channel and extend toward one another along the lower portion of the housing. The forward end portions 49 and 49′ of the flange members are shown as extending inwardly toward one another to a greater extent than the rear end portions 50 and 50' thereof. In this manner, a first elongated narrow passageway 51 is defined between the forward end portions of the flange members while a second wider passageway 52 is created between the rear end portions of the inwardly extending flanges. The rear end portion of the inwardly extending flanges also include oppositely oriented outwardly extending flange portions 53 and 53' which underly the leg portions of the mounting bracket and serve to prevent the mounting bracket from moving vertically within the housing.

The guide channel assembly 44 is utilized to support a telescoping clothing rack assembly 55. The telescoping clothing rack assembly includes an upper support slider member 56 which is of a size to be slidingly received within the guide channel assembly 44 with the lower surface of the slider member engaging the inwardly extending flanges of the guide channel assembly. As shown, the slider member 56 is generally coextensive with the length of the housing 21 and includes a forward end portion 57 to which a handle 58 may be selectively secured. The handle is shown as being cooperatively designed with the outer surface of the housing so that when the support slider member is fully positioned in underlying relationship with the housing, the handle will have the appearance of the forward end of the housing as shown in FIG. 1.

A vertically extending support post assembly 60 is integrally formed with the rear end portion 61 of the slider member 56. The vertical support assembly includes a pair of post elements 62 and 63 which extend from a reinforced neck portion 64 to a lowermost flange connecting portion 65. The innermost post element 62 is shown as being somewhat T-shaped in cross sectional configuration whereas the post element 63 is generally rectangular in cross sectional configuration. The post element 62 and 63 are joined at generally equally spaced intervals along their length by pairs of upper and lower integrally formed flanges 66 and 67. The flanges 66 and 67 are generally horizontally oriented so as to form a bearing area therebetween from which pairs of right and left hand clothing support arm assemblies 70 and 71 are swingably retained.

The clothing support arms include mounting end portions 72 and 73, respectively, which have generally planar upper and lower surfaces. The inner side of the mounting end portions include tapered openings 74 which narrow inwardly to an innermost circular slot 75. During the manufacture or molding of the vertical support assembly, a plurality of pins 76 will be molded between the upper and lower flanges defining the bearing surfaces for the support arms. The mounting portion of the support arms are designed to be lockingly engaged about the pivot pins 76 by inserting the mounting ends toward the pivot pin so that the tapered openings are initially spread apart as the pivot pin passes therethrough. Once the pins align with the circular openings or slots 75, the walls of the slot will close around the pins locking the mounting end portions into secure pivoted engagement therewith.

Figures 2, 3, 17:
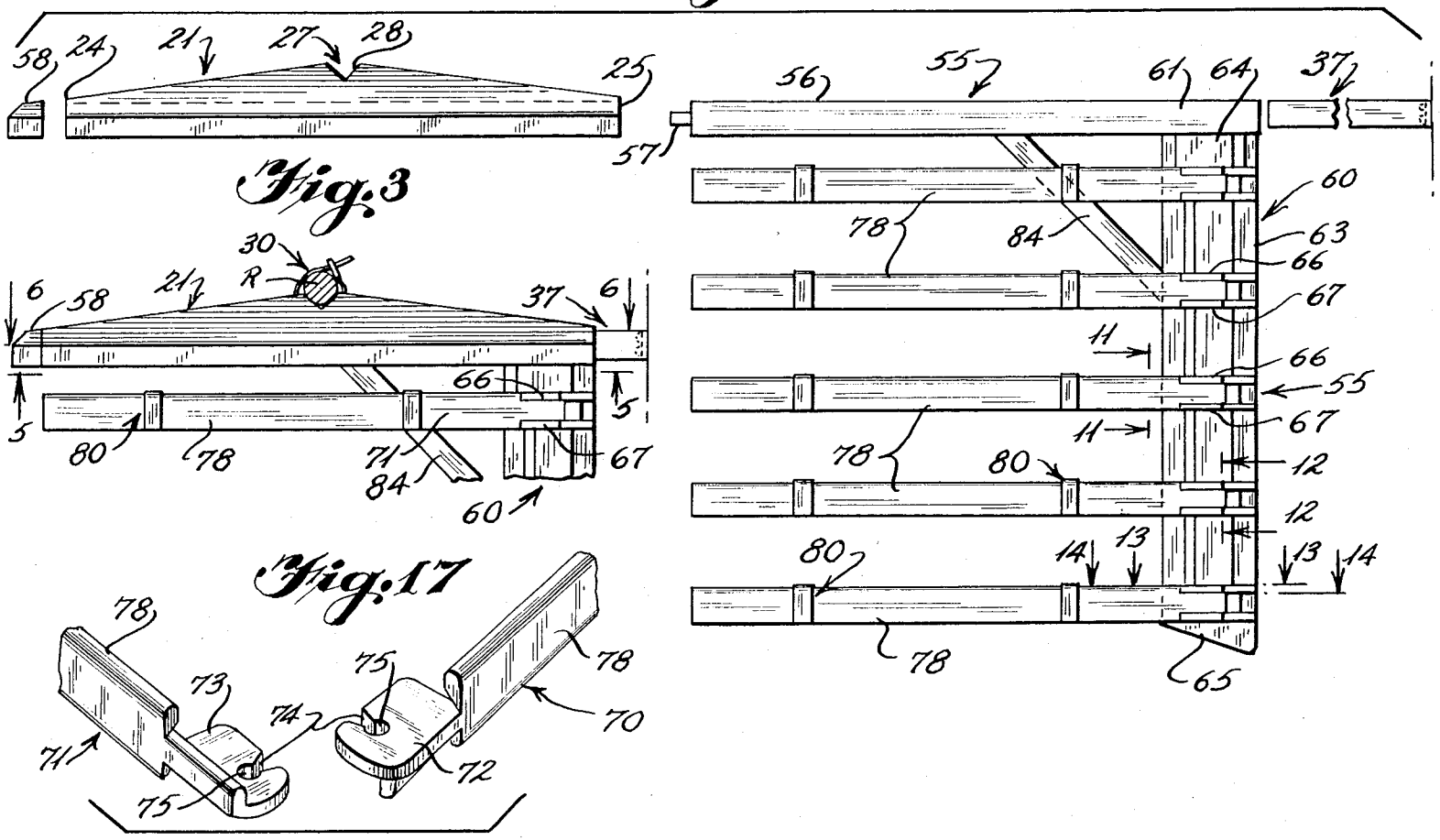
FIG. 2 is an exploded assembly view showing the housing and support rack of the closet organizer of the present invention.
FIG. 3 is a partial side elevational view of the closet organizer of FIG. 1 showing the mounting relationship of the closet organizer with respect to a clothes rod and the rear wall of a closet.
FIG. 17 is a partial assembly view showing the inner pivotal ends of the clothing support arms of the present invention.
Figure 8:
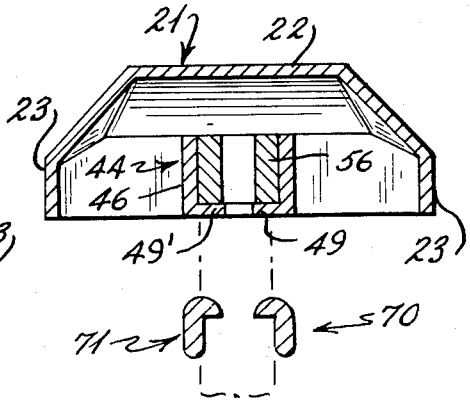
FIG. 8 is an enlarged cross sectional view taken along lines 8—8 of FIG. 4.
Figure 9:
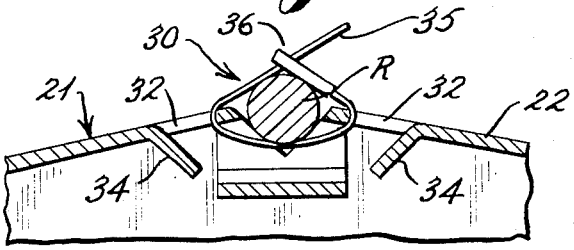
FIG. 9 is an enlarged cross sectional view taken along lines 9—9 of FIG. 4.
Figure 10:
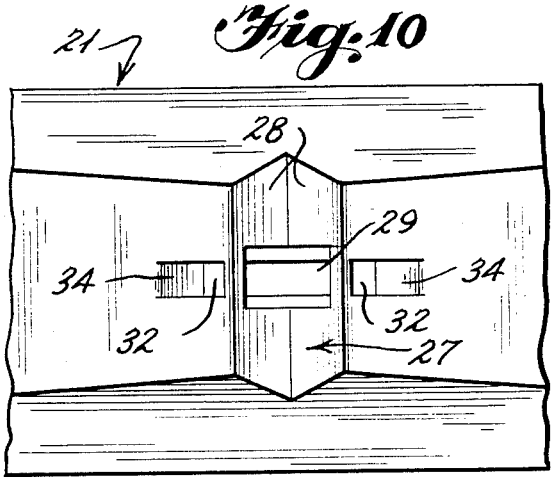
FIG. 10 is an enlarged partial top plan view of the central portion of the housing of FIG. 1.
Figure 11:
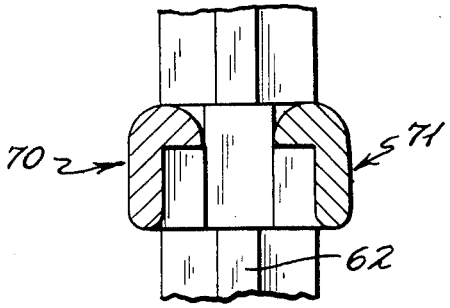
FIG. 11 is an enlarged partial cross sectional view taken along lines 11—11 of FIG. 2.
Figure 12:
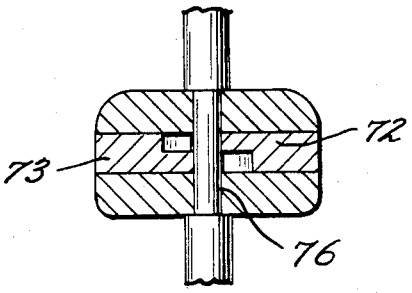
FIG. 12 is an enlarged partial cross sectional view taken along lines 12—12 of FIG. 2.
Figure 13:
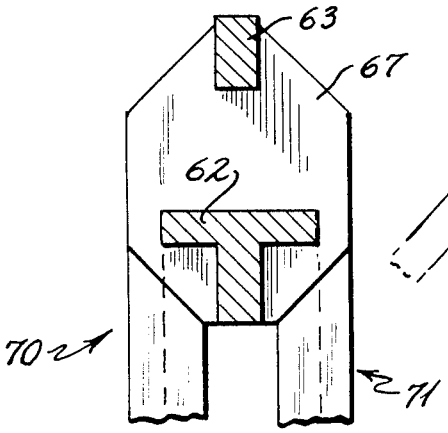
FIG. 13 is an enlarged partial cross sectional view taken along lines 13—13 of FIG. 2.

In order for the mounting end portions 72 and 73 to interfit vertically with respect to one another about the individual pivot pins 76, the right arm mounting end portions 72 are formed so as to overlay the mounting end portions 73 of the left article support arms. A cross section of the ends in overlying relationship is shown in FIG. 8 and an assembly view thereof is shown in FIG. 17.

Figure 14:
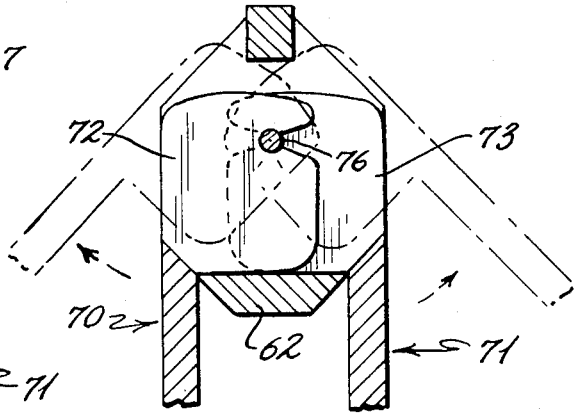
FIG. 14 is an enlarged cross sectional view taken along lines 14—14 of FIG. 2 showing the clothing support arms being swingable as shown in dotted lines.
Figure 15:
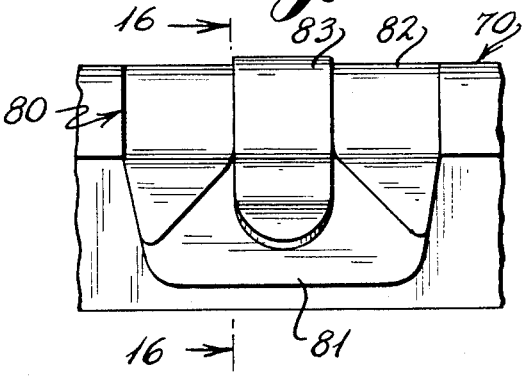
FIG. 15 is an enlarged view of the clothing engaging clips carried by the support arms of the present invention.
Figure 16:
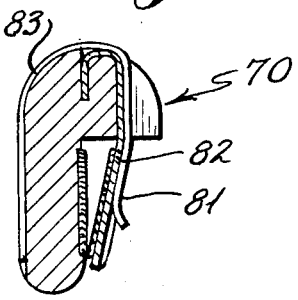
FIG. 16 is a cross section taken along lines 12—12 of FIG. 15.

In addition to the mounting end portions, each support arm includes an elongated rod portion 78 which is defined having a generally arcuate or rounded upper surface and outer depending side wall portions. When the support arms are mounted between the flanges of the vertical support assembly, they will normally be positioned in a closed configuration beneath the housing 21 and will extend generally perpendicularly with respect to one another as shown in cross section and full line in FIG. 14. To further facilitate the mounting of articles to the support arms 70 and 71, each arm may include a pair of clamp elements 80 which may be of conventional design and which may be utilized to clasp an article of clothing between the clamps and the depending wall segments of each rod portion. In this manner, it is possible for each support arm to not only carry an article of clothing between the pair of spaced clamp elements but to also support an article of clothing which is draped over the arcuately formed upper surface of each support rod. Each clamp includes a base portion 81 and flexible outer wall 82. The outer wall 82 is urged toward the base or inner portion 81 by a slideable keeper or spring element 83 which is vertically movable with respect to the upper surface of the rod portion of the support arms. Therefore, when the keeper is in a raised position, the clamp is opened to allow the placement of articles of clothing therein, and when subsequently lowered, the keeper will force the outer wall 82 toward the base portion 81 thereby securing the articles of clothing therebetween.

As previously discussed, the support arms are mounted so as to be swingable outwardly with respect to one another to facilitate access thereto in placing articles of clothing on the arms or taking clothing therefrom. With specific reference to FIG. 14, it is noted that the mounting end portions 72 and 73 of the right and left arm clothing supports 70 and 71 are free to rotate about the pivot pins 76 until the outer edges thereof engage the rear vertical support 63. In practice, such support end portions are generally designed to permit at least a 45° displacement of the support arms relative to their initial storage position which is generally aligned with the elongated axis of the housing. Therefore, in practice, the support arms may be manipulated to 90° or more relative to one another when each is rotated outwardly with respect to the other as shown in dotted line in FIG. 14. Further, when the support arms are rotated towards one another, the outer edge portions of the mounting end portions thereof will also engage the vertical post 62 of the vertical support assembly thereby automatically aligning the arms in a parallel configuration beneath the housing 21.

To distribute the weight which is carried by the article support arms with respect to the slider member 56, a reinforcing gusset 84 extends from a point along the length of the inner vertical support post 62 forwardly and upwardly to a position within a slot 85 formed in the lower portion of the slide member. The gusset will not only reinforce the vertical support posts but will also transfer weight forwardly of the slide member thereby more equally distributing the weight along the length of the slide member and facilitating the movement of the telescoping clothing rack assembly with respect to the housing.

A particular advantage of the telescoping clothing rack assembly of the present invention is that the support arms may be replaced in the event one should become damaged or broken during use. As the arms are designed to be locked into place as discussed about the pivot pins 76, replacement arms can be obtained and installed by snapping each of the arms into locked engagement with the pivot pins by the consumer. Further, although the present embodiment shows five pairs of vertically spaced support arms carried by the vertical support assembly, it should be noted that this number may be varied and that fewer or additional pairs of support arms may be provided.

The housing, mounting bracket, clothing rack assembly and article support arms are preferrably molded of a plastic material. The slide member and vertical support post assembly are also preferrably integrally molded so as to reduce assembly costs and to provide for a more rigid and stronger assembly.

In addition to the foregoing, although only a single inner slide member 56 is disclosed in the preferred embodiment, it is envisioned that secondary slide members may be provided so as to permit additional telescopic displacement of the article support arms relative to the housing. However, due to the amount of clothing which can be supported by the present invention, any additional slide members must be reinforced to insure that they can withstand the stresses imparted thereto and to the housing due to the weight of the articles suspended therefrom.

In the use of the closet organizer of the present invention, once the consumer has mounted the housing to a clothes rod by utilizing the flexible mounting strap, the rearwardly telescoping mounting bracket is extended rearwardly into abutting engagement with the wall of the closet. Thereafter, the bracket assembly is moved vertically until the end wall portion of the bracket is flush against the wall so as to insure that the housing assembly is truly horizontally aligned. The bracket is then secured by a conventional screw or fastener which is extended through the end wall of the bracket and into the wall. The inner slider assembly is extended forwardly of the housing by pulling on the handle and the telescoping clothing rack assembly will move forwardly until the reinforced neck portion of the vertical support post assembly engages with the area adjacent the opening into the elongated narrow passageway defined between the flange elements of the guide channel assembly. The elongated narrow passage 51 is of a size to permit the reinforcing gusset to pass therethrough as the rack assembly is moved forwardly. The limitation to the movement of the telescoping clothing rack assembly will insure that the rack assembly cannot be pulled forwardly from the housing nor can it be pulled to a point where it would create an undue stress on the forward end of the housing which could cause damage to the housing or the mounting bracket assembly.

After the telescoping clothing rack assembly has been moved forwardly of the housing, the article support arms may be urged outwardly with respect to one another to thereby permit easy access thereto to facilitate the placement or the removal of articles of clothing therefrom. As the mounting bracket includes a pair of spaced leg portions, the housing is stabilized from rocking or moving with respect to the clothes rod even when the load on the clothing rack assembly is not balanced.

Articles of clothing may be clamped and/or draped over each of the article support arms after which the arms are pivoted into parallel alignment. The clothing rack assembly may then be pushed rearwardly to a storage position beneath the organizer housing. The housing is designed so that the side walls thereof extend beyond or outwardly with respect to the article support arms when the arms are in parallel alignment and thereby insures proper spacing of articles of clothing supported on the support arms with respect to other articles which may be suspended from the clothes rod.

We claim:

1. An extendable closet organizer for supporting a plurality of garments from the clothes rod in a closet comprising a housing, said housing having an upper surface and forward and rear end portions, first mounting means for securing said housing to the clothes rod, said housing having inner guide means therein, a telescoping clothing rack assembly movably mounted within said guide means, said telescoping clothing rack assembly including a slide member which is receivable within said guide means, said telescoping clothing rack assembly including a slide member which is receivable within said guide means of said housing, and a depending vertical means carried by said slide member, a plurality of bearing means carried by said vertical support means in vertically spaced relationship below said slide member, a plurality of pairs of opposing article support rod means having first and second end portions, said first end portions of a pair of said article support rod means being mounted within each of said plurality of bearing means so that said support rod means are pivotable with respect thereto, said second end portions of said support rod means extending outwardly from said bearing means, each of said pairs of said article support rod means being normally disposed in adjacent parallel relationship with respect to one another and beneath and generally parallel to said housing and being selectively swingable outwardly away from one another so as to extend outwardly with respect to said housing.

2. The extendable closet organizer of claim 1 in which said slide member has forward and rear end portions, said depending vertical support means extending downwardly adjacent said rear end portion of said slide member and said article support rod means extending forwardly of said vertical support means, a reinforcing member extending between said depending vertical support means and said slide member and oriented intermediate at least one of said pairs of opposing article support rod means.

3. The extendable closet organizer of claim 1 in which each of said article support rod means includes a generally rounded upper edge portion over which an article may be selectively draped.

4. The extendable closet organizer of claim 1 including second mounting means slideably carried within said housing and being selectively extendable from said rear end portion thereof and means for securing said second mounting means to a surface remote from the clothes rod.

5. The extendable closet organizer of claim 4 in which said first mounting means includes a V-shaped slot depending into said upper surface of said housing, said V-shaped slot having inwardly tapering opposing side walls spaced below said upper surface of said housing which are engagable with the clothes rod, and means for urging said inwardly tapering side walls into intimate contact with said clothes rod.

6. The extendable closet organizer of claim 5 including a pair of spaced openings in said upper surface of said housing adjacent each of said inwardly tapering side walls of said V-shaped slot, a passageway defined between each of said openings within said housing, flexible strap means extending through said spaced openings and said passageway defined therebetween, said strap means including locking means for securing said strap means over the clothes rod.

7. The extendable closet organizer of claim 1 in which at least one of said article support rod means includes at least one clamping means being operable to secure an article of clothing to said at least one article support rod means.

8. The extendable closet organizer of claim 1 in which each of said bearing means includes outwardly extending and generally horizontally oriented flange means, and a pivot pin means carried by said flange means and extending perpendicularly thereto.

9. The extendable closet organizer of claim 8 in which each of said first end portions of said article support rod means includes an opening therethrough, said pivot pin means being extendable through said openings.

10. The extendable closet organizer of claim 9 in which each of said first end portions of said article support rod means includes a side wall portion having an inwardly tapering slot therein, said slots through each of said first end portions communicating with said openings therethrough, said pivot pin means being of a size to be urged through said slots and having a diameter which is greater than the minimum width of said inwardly tapering slots.

11. The extendable closet organizer of claim 9 in which said first end portions of each of said pairs of said article support rod means are in overlapping relationship with respect to one another about said pivot pin means.

12. The extendable closet organizer of claim 8 in which said first end portion of said article support rod means are removably mounted about said pivot pin means.

13. The extendable closet organizer of claim 12 in which at least one of said article support rod means includes at least one clamping means, said clamping means being operable to secure an article of clothing to said article support rod means.

14. The extendable closet organizer of claim 12 including a reinforcement gusset member, said reinforcement gusset member extending diagonally between said vertical support means and said slide member so as to be intermediate at least one of said pairs of said opposing article support rod means.

15. The extendable closet organizer of claim 1 including means for limiting the pivotal movement of each of said pairs of article support rod means both toward and away from one another.

16. An extendable closet organizer for supporting a plurality of garments from the clothes rod in a closet comprising a housing, said housing having an upper surface and forward and rear end portions, first mounting means for securing said housing to the clothes rod, said housing having inner guide means therein, a telescoping clothing rack assembly movably mounted within said guide channel means, said telescoping clothing rack assembly including a slide member which is receivable within said guide channel means of said housing and a depending vertical support means, a plurality of bearing means carried by said vertical support means and vertically spaced with respect to one another below said slide member, a plurality of pairs of opposing article support rod means, a pair of said article support rod means being mounted within each of said bearing means, each of said article support rod means having first and second end portions, said first end portions of said article support rod means being pivotally mounted with respect to said bearing means, said second end portions of said support rod means extending outwardly from said bearing means and generally parallel to said housing, second mounting means for securing said housing to a surface remote from the clothes rod, said second mounting means including a bracket means carried by said housing and being extendable outwardly with respect to said rear end portion thereof so as to be selectively engagable with the surface which is remote from the clothes rod, each of said pairs of said article support rod means being normally disposed in adjacent parallel relationship with respect to one another and beneath said housing and being selectively swingable outwardly away from one another so as to extend outwardly with respect to said housing.

17. The extendable closet organizer of claim 16 in which said bracket means includes first and second generally parallel leg portions having inner and outer ends, said inner ends of said leg portions being disposed within said housing, an abutment wall portion connecting said outer ends of said leg portions of said bracket means and fastening means for securing said abutment wall portion to the remote surface.

18. The extendable closet organizer of claim 17 in which said first mounting means includes a V-shaped slot formed in said upper surface of said housing, said V-shaped slot having inwardly tapering opposing side walls which are engagable with the clothes rod, and means for urging said inwardly tapering side walls into intimate contact with said clothes rod.

19. The extendable closet organizer of claim 16 in which said article support rod means are removably mounted with respect to said bearing means.

20. The extendable closet organizer of claim 19 in which at least one of said article support rod means includes at least one clamping means, said clamping means being operable to secure an article of clothing to said article support rod means.

21. The extendable closet organizer of claim 19 in which each of said bearing means includes a pair of spaced apart outwardly extending and generally horizontally oriented flange means, and a pivot pin means extending perpendicularly between said flange means, each of said first end portions of said article support rod means including a side wall portion having an inwardly tapering slot therein, an opening through each of said first end portions and communicating with said slots, said pivot pin means being extendable through said openings in said first end portions and having a diameter which is greater than the minimum width of said inwardly tapering slots.

22. The extendable closet organizer of claim 21 in which said vertical support means includes inner and outer vertically oriented post members, each of said bearing means being oriented between said inner and outer post members, said inner post member being of a configuration to limit the pivotal movement of said pairs of article support rod means toward one another so that each pair of said article support rod means are in generally parallel relationship when in a closed position with respect to one another, and said outer post member being of a configuration to limit the pivotal movement of said pairs of article support rod means away from one another.

23. An extendable closet organizer for supporting a plurality of articles from a clothes rod which is spaced from a wall of a closet comprising a housing, said housing having an upper surface and forward and rear end portions, first mounting means for securing said housing to the clothes rod, said housing having inner guide means therein, at least one telescoping slide member movably mounted within said guide means so as to be extendable outwardly of said forward end portion of said housing, an article support rack means carried by said at least one telescoping slide means, second mounting means for securing said housing to the wall of the closet spaced from the clothes rod, said second mounting means including a bracket means having inner and outer ends, said inner end being slideably carried with said housing and being extendable outwardly with respect to said rear end portion thereof so as to be selectively engageable with the wall of the closet, and means for securing said bracket means to the wall whereby said bracket means stabilizes said housing with respect to the clothes rod.

24. The extendable closet organizer of claim 23 in which said bracket means includes first and second spaced apart and generally parallel leg portions having inner and outer ends, said inner ends of said leg portions being disposed within said housing, an abutment wall portion connecting said outer ends of said leg portions of said bracket means, and said means for securing said bracket means to the wall including fastening means for securing said abutment wall portion to the wall.

25. The extendable closet organizer of claim 24 in which said first mounting means includes a V-shaped slot formed in said upper surface of said housing, said V-shaped slot having inwardly tapering opposing side walls which are engagable with the clothes rod, and means for urging said inwardly tapering side walls into intimate contact with said clothes rod.

26. The extendable closet organizer of claim 25 including a pair of spaced openings in said upper surface of said housing adjacent each of said inwardly tapering side walls of said V-shaped slot, a passageway defined between each of said openings within said housing, flexible strap means extending through said spaced openings and said passageway defined therebetween, said strap means including locking means for securing said strap means over the clothes rod.

27. The extendable closet organizer of claim 25 in which said upper surface of said housing tapers downwardly in opposite directions from said V-shaped slot toward said forward and rear end portions thereof whereby said housing has a greater depth in the area of said V-shaped slot.

28. An extendable closet organizer for supporting a plurality of garments from the clothes rod in a closet comprising a housing, said housing having an upper surface and forward and rear end portions, first mounting means for securing said housing to the clothes rod, second mounting means for securing said housing to a surface remote from the clothes rod, said second mounting means including a bracket means carried by said housing and being extendable outwardly with respect to said rear end portion thereof so as to be selectively engagable with the remote surface, said bracket means including first and second generally parallel leg portions having inner and outer ends, said inner ends of said leg portions being disposed within said housing, an abutment wall portion connecting said outer ends of said leg portions of said bracket means and means for securing said abutment wall portion to the remote surface, said housing having inner guide means therein, a telescoping clothing rack assembly movably mounted within said guide means, said telescoping clothing rack assembly including a slide member which is receivable with said guide means of said housing and a depending vertical support means, said slide member having forward and rear end portions, said vertical support means extending downwardly adjacent said rear end portion of said slide member, at least one bearing means carried by said vertical support means and vertically spaced below said slide member, at least one pair of opposing article support rod means having first and second end portions, said first end portions of said article support rod means being mounted within said least one of said bearing means and being pivotable with respect thereto, said second end portions of said support rod means extending outwardly from said at least one of said bearing means, said article support rod means extending forwardly of said vertical support means, each of said pairs of said article support rod means being normally disposed in adjacent parallel relationship with respect to one another and beneath and generally parallel to said housing and being selectively swingable outwardly away from one another so as to extend outwardly with respect to said housing.

* * * * *